US007059432B2

(12) United States Patent
Hauptmann et al.

(10) Patent No.: US 7,059,432 B2
(45) Date of Patent: Jun. 13, 2006

(54) CUP-SHAPED ROCK DRILL HEAD

(75) Inventors: Udo Hauptmann, Landsberg/Lech (DE); Peter Sternberger, Augsburg (DE); Reinhard Schulz, Munich (DE); Martin Richter, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 107 days.

(21) Appl. No.: 10/686,852

(22) Filed: Oct. 15, 2003

(65) Prior Publication Data

US 2004/0079554 A1 Apr. 29, 2004

(30) Foreign Application Priority Data

Oct. 24, 2002 (DE) ..... 102 49 564

(51) Int. Cl.
*E21B 43/34* (2006.01)

(52) U.S. Cl. ..... 175/414; 175/415; 299/100

(58) Field of Classification Search ..... 175/414, 175/415; 299/100
See application file for complete search history.

(56) References Cited

U.S. PATENT DOCUMENTS 3,213,951 A * 10/1965 Eeles ..... 175/414
4,022,287 A * 5/1977 Lundstrom et al. ..... 175/393
4,223,587 A * 9/1980 Deutschenbaur ..... 411/31
4,716,976 A * 1/1988 Isakov ..... 175/426

* cited by examiner

*Primary Examiner*—George Suchfield
(74) *Attorney, Agent, or Firm*—Abelman, Frayne & Schwab

(57) ABSTRACT

A cup-shaped drill head with an inner conical surface (2) for force-locking connection with an exterior conical surface (3) of a driving drill shaft (4), which at the leading end changes over into a cup base (5) with a center point (P), whereby in the change over from the cup base (5) to the inner conical surface (2) a lesser curvature (K) is present than at the center point (P).

8 Claims, 1 Drawing Sheet

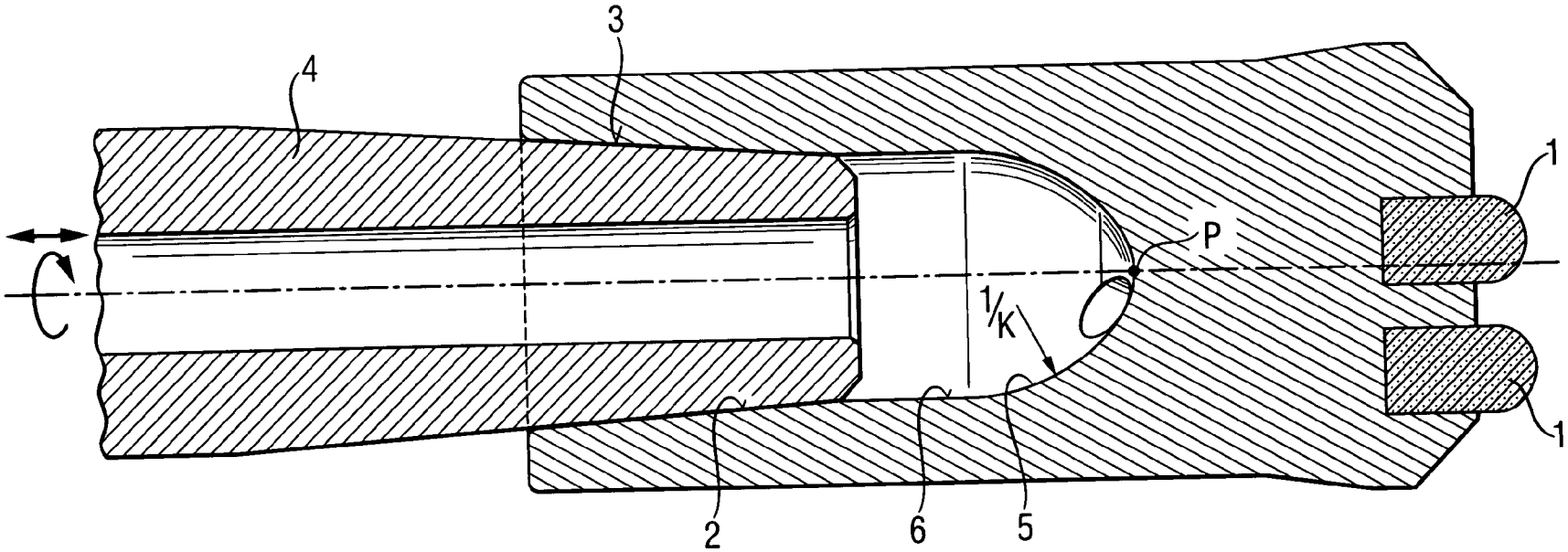
1
1
P
1/K
5
6
2
3
4

CUP-SHAPED ROCK DRILL HEAD

FIELD OF INVENTION

The invention relates to a cup-shaped drill head, in particular for rotary-percussive drilling of blast holes in rock.

BACKGROUND OF THE INVENTION

In the case of rotary and percussive drilling of blast holes in rock, hard material drill heads are connected non-rotatingly with a hollow drill shaft, which is driven at least partially rotatingly and percussively by a shank end of a drill tool.

For force-form fitting connection between the tool end of the drill shaft and the drill head, the drill shaft has a conical surface and a cup-shaped drill head has an associated inner conical surface. The cup base of the drill head is especially subjected to high alternating stresses by virtue of the intensive percussive stress developed via the included angle of the cup base, which in local areas of high stress intensities can result in material fatigue and ultimately in failure.

U.S. Pat. No. 4,716,976 discloses a cup-shaped drill head wherein the extension of the inner conical surface on the leading end has an inner cylindrical surface having a zero curvature in longitudinal cross-section and a connecting mathematically smooth inner spherical cap as the base of the cup, whose uniform curvature corresponds to the reciprocal value of the inner cylindrical radius. The mathematically smooth curvature that is the angle-free change over from the inner cylindrical surface to the inner spherical cap results at this location in a locally increased material stressing, which as van Mieses failure criteria, for example, consequently defines the load limit of the drill head.

SUMMARY OF THE INVENTION

The object of the invention is to provide a cup-shaped rock drill head having a higher load capacity in a given material and dimensional specifications.

Essentially, a cup-shaped drill head has an inner conical surface for force-locking connection with an external conical surface of a driving drill shaft, which at the leading end changes over into a cup base having a center point, whereby at the change over from cup base to inner conical surface there is a lesser curvature than at the center point.

By virtue of the change over being of lesser curvature than at the center point, a drill head can be formed, which prevents larger curvature changes in the critical change over zone and consequently in existing material and dimensional specifications, having lesser local material loading, whereby the loading capacity of the drill head is increased.

Advantageously, there is an inner cylindrical surface abutting at the leading end of the inner conical surface, which in longitudinal section has a zero curvature, whereby the end of the inner conical surface at the leading end forming an intentional break zone is loaded to a lesser degree.

Advantageously, the change over from the cup base to the inner conical surface or inner cylindrical surface is mathematically smooth, whereby the notch stresses at the inner edges can be prevented.

Advantageously, the drill head at the leading end has, from the inner conical surface to the center point, at least three different curvatures in terms of magnitude, including an optional inner cylinder surface having zero curvature in longitudinal section, whereby changes in curvature are discretely stepped.

Advantageously, at the leading end the drill head forms a rotational inner surface of a mathematically analytical, hence frequently consistently differentiable function from the inner conical surface or inner cylindrical surface to the center point, whereby a continuous change in curvature results.

Advantageously, the rotational inner surface is mathematically of the second order, whereby a uniform curvature change results.

Advantageously, the rotational inner surface is a hyperparaboloid with the apex at the center point or a hyperellipsoid with the longest radius at the center point and a mathematically smooth change over to the inner conical surface or the inner cylindrical surface, whereby a low curvature occurs at the change over.

BRIEF DESCRIPTION OF THE DRAWING

The invention will now be more completely described using an advantageous exemplary embodiment with reference to a representation of the drill head in longitudinal cross-section.

DETAILED DESCRIPTION OF THE INVENTION

According to the drawing, a cup-shaped drill head has a leading end and a trailing end with hard material insets 1 on the leading end and an inner conical surface 2 at the trailing end for force-locking connection with an external conical surface 3 of a rotary-percussively driven drill shaft 4. The inner conical surface 2 changes over at the leading end into a cup base 5 with a center point P on the axis, whereby in the change over from the cup base to the inner conical surface 2 a lower curvature K exists than at that of the center point P. At the leading end of the inner conical surface 2 an inner cylindrical surface 6 abuts on the exterior conical surface 3, the conical surface exhibiting a curvature K=zero in the illustrated longitudinal cross-section. The change over from the cup base 5 to the inner cylindrical surface 6 is mathematically smooth. At the leading end of the inner cylindrical surface 6 to the center point P, a rotational inner-form surface of a hyperellipsoid is formed with the longest radius at the center point P.

The invention claimed is:

1. A cup-shaped drill head having an axis with a leading end and a trailing end and an inner space extending axially from the trailing end toward the leading end with an inner axially extending conical surface (2) extending from the trailing end for force-locking connection to an outer axially extending conical surface (3) of a driving drill shank (4), said inner space having a cup base (5) having a variable curvature (K) with a center point (P) of said variable curvature located on said drill head axis adjacent said leading end and said variable curvature extending toward said inner conical surface (2), wherein at a transition from said cup base (5) to said inner conical surface (2) the curvature (K) of said cup base (5) is smaller than the curvature at the center point (P).

2. A cup-shaped drill head, as set forth in claim 1, wherein said inner space has an inner cylindrical surface (6) extending axially from said cup base to said inner conical surface (2).

3. A cup-shaped drill head, as set forth in claim 2, wherein the transition from said cup base (5) to at least one of said inner conical surface (2) and said inner cylindrical surface (6) is mathematically smooth.

4. A cup-shaped drill head, as set forth in claim 3, wherein said inner space at the leading end thereof has a rotational inner surface of a mathematically analyzable function from at least one of said inner conical surface (2) and said inner cylindrical surface to said center point (P).

5. A cup-shaped drill head, as set forth in claim 4, wherein said rotational inner surface is mathematically of the second order.

6. A cup-shaped drill head, as set forth in claim 4, wherein said rotational inner surface is a hyperparaboloid with an apex thereof at the center point (P) and has a mathematically smooth transition to at least one of said inner conical surface (2) and said inner cylindrical surface (6).

7. A cup-shaped drill head, as set forth in claim 4, wherein said rotational inner surface is a hyperellipsoid with a longest radius at said center point (P) and a mathematically smooth transition to at least one of said inner conical surface (2) and said inner cylindrical surface (6).

8. A cup-shaped drill head, as set forth in claim 1, wherein said cup base (5) has at least three uniformly increasing curvatures (K) differing in magnitudes from said conical surface (2) to the center point (P).

* * * * *